US006920979B2

(12) United States Patent
Chandaria

(10) Patent No.: US 6,920,979 B2
(45) Date of Patent: Jul. 26, 2005

(54) TAPE DISPENSER AND HANG TAG FOR USE THEREWITH

(76) Inventor: Ashok Chandaria, P.O. Box 48020, Nairobi (KE)

( * ) Notice: Subject to any disclaimer, the term of this patent is extended or adjusted under 35 U.S.C. 154(b) by 138 days.

(21) Appl. No.: 10/376,545

(22) Filed: Feb. 25, 2003

(65) Prior Publication Data

US 2004/0163989 A1 Aug. 26, 2004

(51) Int. Cl.[7] ..... B65D 85/672
(52) U.S. Cl. ..... 206/397; 206/411; 206/806
(58) Field of Search ..... 206/397, 408, 206/411, 806

(56) References Cited

U.S. PATENT DOCUMENTS 4,899,882 A * 2/1990 Benner ..... 206/470
5,083,717 A * 1/1992 Samuelson et al. ..... 242/588.6
5,672,238 A * 9/1997 Samuelson ..... 156/579
6,196,389 B1 * 3/2001 Buetter et al. ..... 206/397
6,244,444 B1 * 6/2001 Jacobus et al. ..... 206/703

* cited by examiner

*Primary Examiner*—Jacob K. Ackun, Jr.
(74) *Attorney, Agent, or Firm*—Sand & Sebolt

(57) ABSTRACT

A tape dispenser and a hang tag for use therewith are disclosed. The tape dispenser includes a front and back that are joined together to form a housing that holds a roll of adhesive tape. A hang tag is provided to attach the tape dispenser to a display board. The hang tag is secured within the housing and it includes a tab section and a lower section. The lower section has the same shape as the housing and it is secured within the housing. The tab is connected to the lower section and extends from the upper surface of the housing. The tab includes an aperture for receiving a hook for hanging the tape dispenser onto a display board. The tab also includes perforations for allowing the tab to be separated from the lower section after purchase of the tape dispenser. The tab is substantially smaller than the lower section or the housing thereby reducing the overall size of the product to be either transported or displayed.

12 Claims, 3 Drawing Sheets

TAPE DISPENSER AND HANG TAG FOR USE THEREWITH

BACKGROUND OF THE INVENTION

1. Technical Field

This invention generally relates to tape dispensers. More particularly, the invention relates to a tape dispenser that includes a hang tag for displaying the tape dispenser in a retail setting. Specifically, the invention relates to a tape dispenser that includes a hang tag that is relatively small when compared to the size of the tape dispenser.

2. Background Information

There are a variety of ways that retailers use to display products. Some products are placed on shelves while others are hung from display clip strips or sheets. Products that are hung from displays need to have some sort of mechanism for actually attaching the product to the display. This may be achieved by a small aperture being made in the packaging for the product and then a hook from the display board or strip is inserted through the aperture. Alternatively, a cardboard backing sheet may be attached to the product and an aperture may be made in the backing sheet. The hook from the display strip may then be passed through the aperture in the cardboard backing sheet. Attaching cardboard backing sheets is not only expensive, but the backing sheets take up a lot of packaging space during shipping and display space in the retail environment. This reduces the amount of product that the manufacturer is able to ship or to display, thereby driving the cost up for that particular product.

There is therefore a need in the art for an inexpensive, less space-consuming way to ship products or hang products on display sheets.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

DETAILED DESCRIPTION OF THE INVENTION

Figure 1:
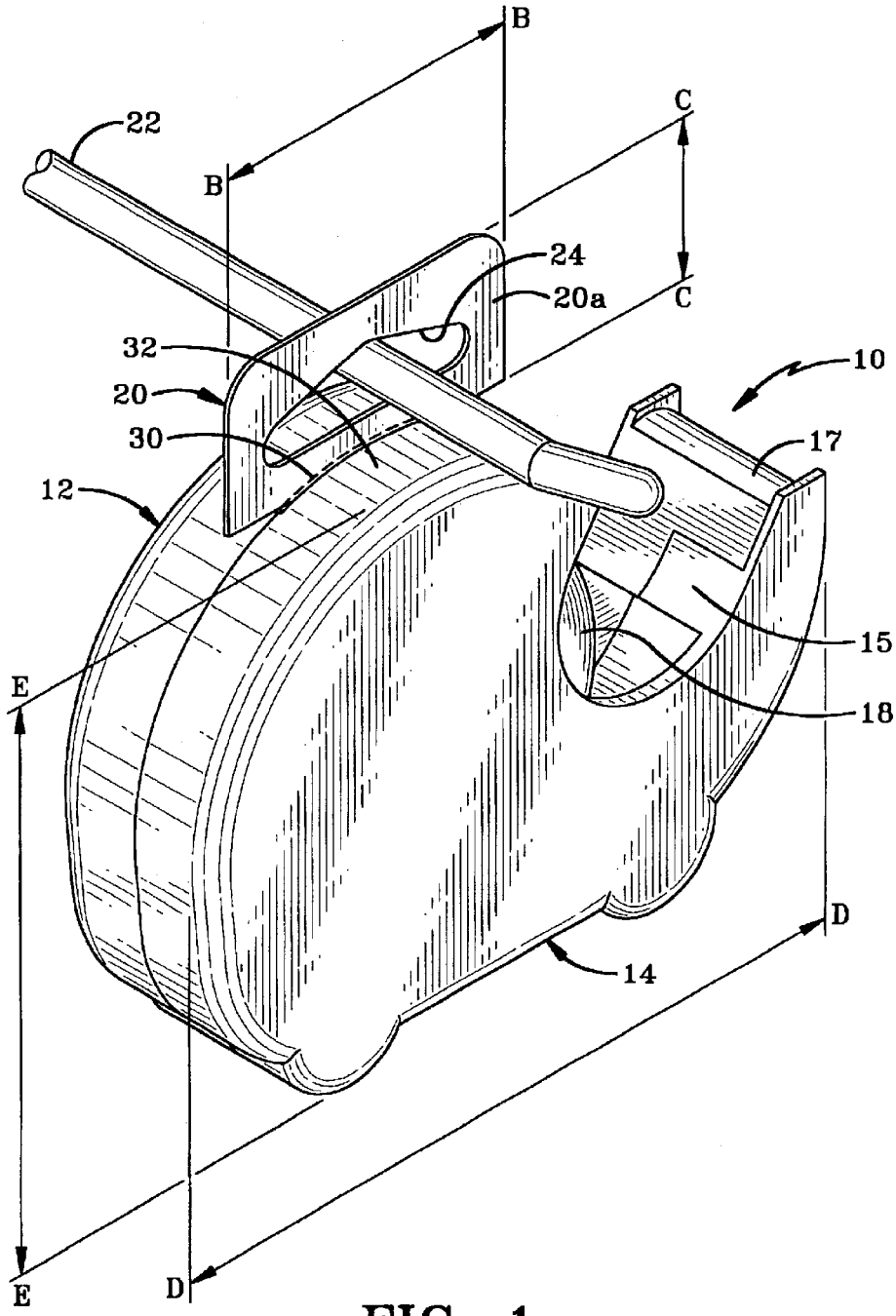
FIG. 1 is a perspective front view of a tape dispenser in accordance with the present invention, where the tape dispenser is suspended from a display hook by way of the hang tag of the present invention.
Figure 2:
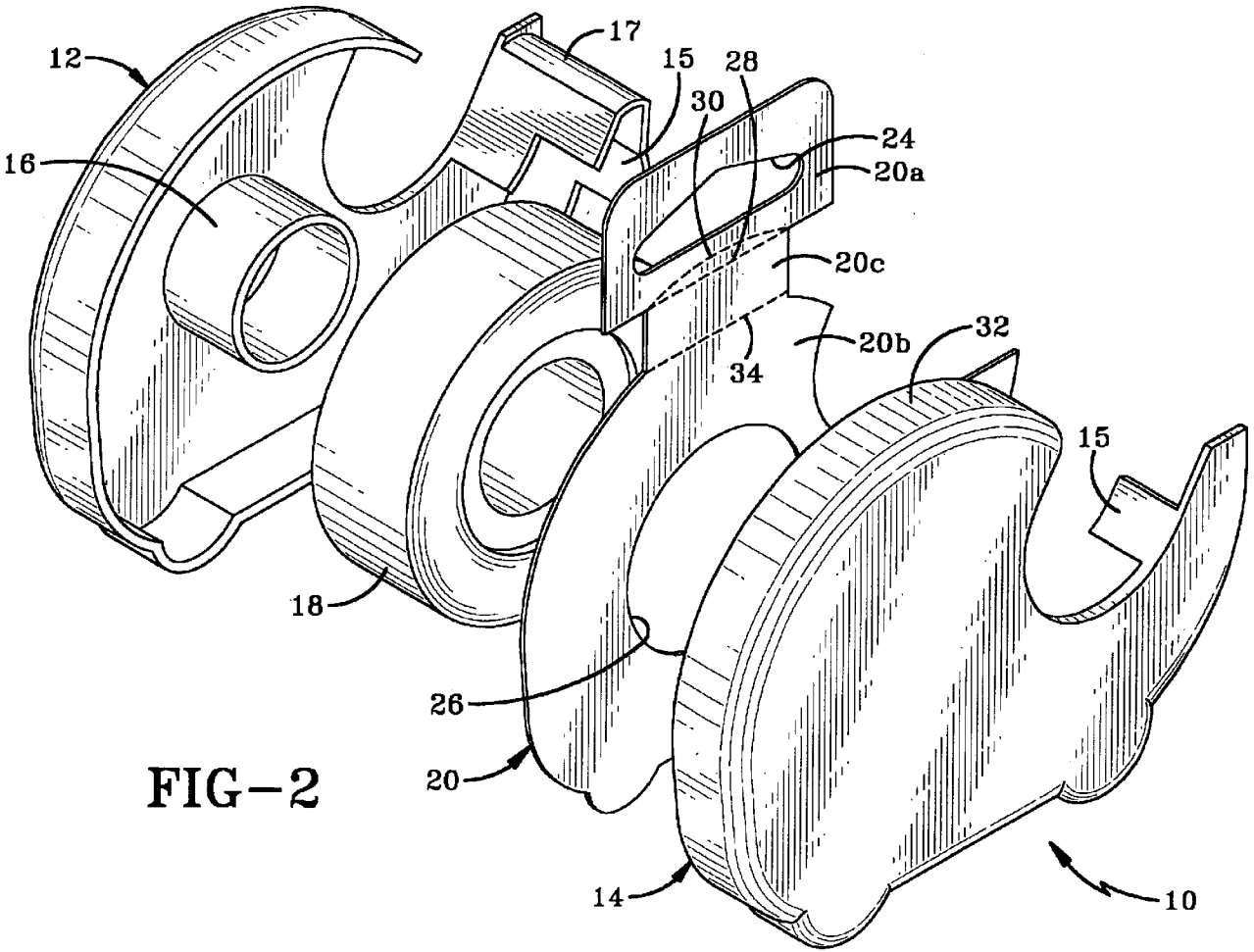
FIG. 2 is an exploded perspective front view of the tape dispenser.
Figure 3:
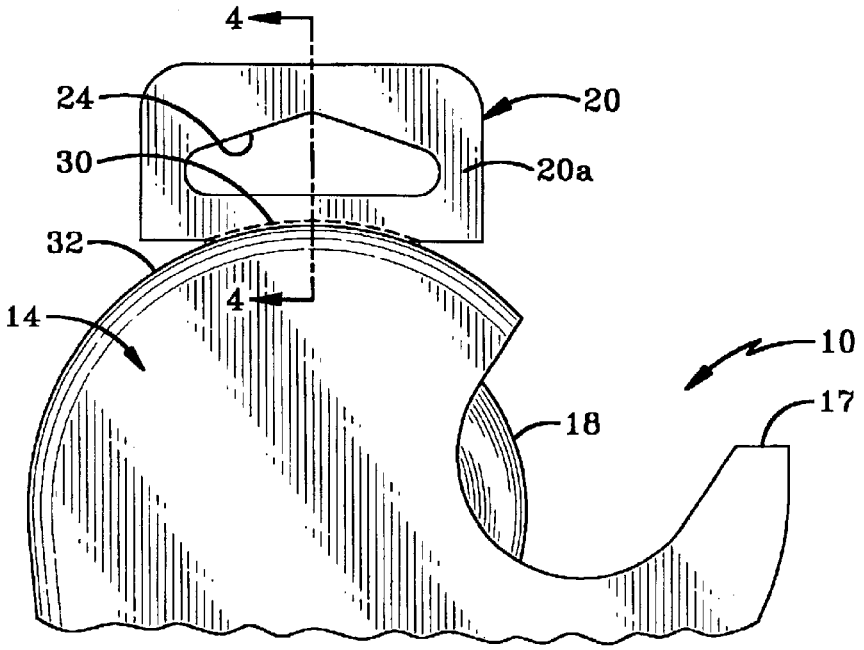
FIG. 3 is a front view of the tape dispenser showing the hang tag.

Referring generally to FIGS. 1–5, there is shown a tape dispenser, generally referred to by the number 10. Tape dispenser 10 has a back 12 and a front 14. Front 14 and back 12 may be snap connected together by clips 15 to form a single housing. Front 14 and back 12 may alternatively be glued together, hinged together or connected together in any other suitable way without departing from the scope of the present invention.

Back 12 preferably includes an internal tape support 16 for receiving a roll of adhesive tape 18 thereon. Front 14 and back 12 connect together so that the roll 18 of tape is securely held within dispenser 10. While tape support 16 is shown as extending from back 12, it may extend from front 14 or extend partially from the front 14 and back 12 of the dispenser 10 without departing from the scope of the invention. Back 12 further includes a lip 17 over which tape from roll 18 may be drawn and cut. Front 14 is similarly shaped to back 12, but in the embodiment shown in FIG. 2, front 14 does not include lip 17. Lip 17 may, however, be disposed either fully on front 14 or partially on front 14 and back 12, without departing from the scope of the invention.

A hang tag in accordance with the present invention, generally referred to by the number 20, is provided to allow tape dispenser 10 to be hung from a hook 22 or other type of product display. Hang tag 20 has a tab 20*a* and a lower section 20*b*. Tab 20*a* defines an aperture 24 through which hook 22 may be received. In the preferred embodiment, tab 20*a* is generally rectangular in shape. Furthermore, aperture 24 is generally triangular in shape so as to allow for hang tag 20 to engage a variety of differently shaped and sized hooks. The triangular shape allows the hook to be quickly and easily centralized in tab 20*a* so that the dispenser 10 hangs straight on the display (not shown). While tab 20*a* is shown to be generally rectangular and aperture 24 is generally triangular in shape, it will be understood by those skilled in the art that other shaped tabs and/or apertures may be provided without departing from the scope of the invention. For example, a generally rectangular tab (not shown) may be provided with a small circular aperture (not shown) therein. Alternatively, tab 20*a* may be square, semi-circular or circular with a triangular, square or circular aperture therein.

Lower section 20*b* is configured to be the same shape as the front 14 of tape dispenser 10. Product information may be printed on lower section 20*b* if front 14 of dispenser is to be transparent. Lower section 20*b* defines a hole 26 through which tape support 16 is received. When tape support 16 is received through hole 26, hang tag 20 is securely held within tape dispenser 10 and is prevented from slipping out of tape dispenser 10.

Figure 4:
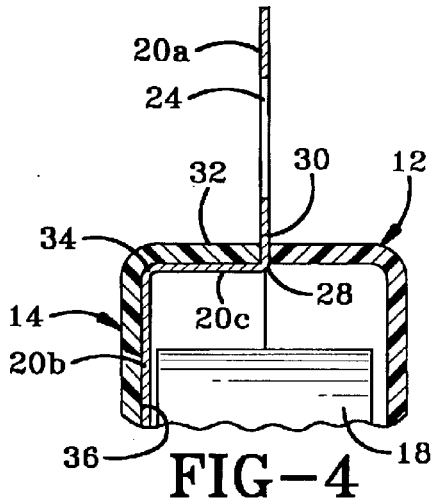
FIG. 4 is a cross-sectional side elevational view of the hang tag through line 4—4 of FIG. 3.

Hang tag 20 further includes a generally rectangular neck section 20*c* that is disposed between tab 20*a* and lower section 20*b*. A first fold line 28 is provided between tab 20*a* and neck section 20*c*. A plurality of perforations 30 are provided in tab 20*a* disposed a small distance from fold line 28. Perforations 30 are preferably formed in an arc shape that configures to the shape of upper surface 32 of dispenser 10. As may be most clearly seen from FIGS. 1, 3 & 5, perforations 30 lie a small distance above the upper surface 32 of tape dispenser 10 when hang tag 20 is secured within dispenser 10. A second fold line 34 is provided between neck section 20*c* and lower section 20*b* of hang tag 20. First and second fold lines 28, 34 allow lower section 20*b* to be folded so that it abuts the inner surface 36 of front 14 of dispenser 10 (FIG. 4). While in the preferred embodiment it is shown that lower section 20*b* abuts front 14 of dispenser 10, it will be understood by those skilled in the art that lower section 20*b* may instead abut back 12 of the dispenser without departing from the scope of the invention.

Dispenser 10 may be used as follows. During manufacture, a roll 18 of adhesive tape is slid onto tape support 16. Hang tag 20 is slid onto tape support 16, tape support 16 being received through hole 26 in lower section 20*b*. Back 12 is moved into engagement with front 14. As this occurs, folds are formed along fold lines 34 and 28 and lower section 20*b* is brought into abutting relationship with inner surface 36 of front 14. At this point, tab 20*a* extends from upper surface 32 of dispenser 10. Tab 20*a* lies substantially normal to upper surface 32 of dispenser 10. Front 14 and back 12 are brought together until clips 15 lock, thereby securing front 14 and back 12 together. Dispenser 10 may then be hung from a display board (not shown) by hook 22 being passed through aperture 24 in tab 20*a*.

Figure 5:
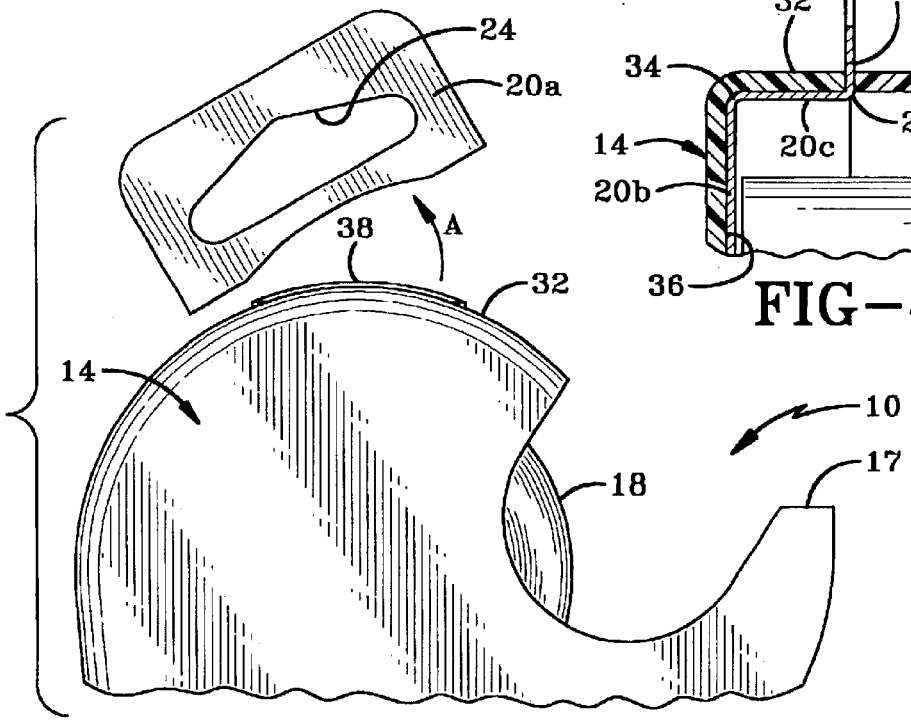
FIG. 5 is a front view of the tape dispenser showing the hang tag being removed therefrom.

The consumer removes dispenser 10 from the display by simply sliding tab 20*a* off hook 22. When the consumer wishes to use the tape on roll 18, they may either leave tab 20*a* on dispenser 10 or may tear tab 20*a* off dispenser 10 by pulling tab 20*a* in the direction of arrow A (FIG. 5). This causes perforations 30 to tear, separating tab 20*a* from neck section 20*c*. When tab 20*a* is removed, a small piece 38 of neck 20*c* may be left extending upwardly from upper surface 32 of dispenser as is shown in FIG. 5.

As may be seen from FIG. 1, tab 20*a* is substantially smaller than the tape dispenser 10. In the preferred embodiment of the invention, tab 20*a* is about 4.5 cm long, as shown by line BB, and is about 2.2 cm high, as shown by line CC. The tape dispenser 10 is about 10.2 cm long, as shown by line DD, and is about 7.5 cm high, as shown by line EE. The area of tab 20*a* is therefore approximately 9.9 $cm^2$, while the area of tape dispenser 10 is approximately 76.5 $cm^2$. The area of tab 20*a* is therefore approximately 13% of the area of tape dispenser 10. Generally the area of hang tag 20 is less than 50% of the area of the housing of tape dispenser 10. More specifically, the area of tab 20*a* is less than 20% of the area of the housing of the tape dispenser 10 and it is preferably between 10 and 15% of the area of tape dispenser 10. This reduced size cuts down on packaging and display space required to accommodate the tape dispenser 10 during transportation and display. This in turn reduces the cost of transporting or displaying the tape dispensers in accordance with the present invention. Tab 20*a* may be folded along perforations 30 so that it rests at least partially against upper surface 32 of dispenser 10, thereby reducing the necessary packaging space even further. Less space is taken up when hanging dispenser 10 from a hook 22 because tab 20*a* is of such a reduced size in comparison to dispenser 10. This reduces the amount of valuable retail space that the dispenser 10 occupies, thereby reducing the costs associated with displaying the dispensers even further.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A tape dispenser for dispensing adhesive tape, said tape dispenser comprising:

a front having an interior surface;

a back having an interior surface and being engageable with the front to form a housing;

a tape support disposed on the interior surface of at least one of the front and back; said tape support being adapted to hold a roll of adhesive tape thereon;

a hang tag secured within the housing, said hang tag being adapted to engage a display board, whereby the area of the hang tag is less than 50% of the area of the housing;

wherein the hang tag defines a hole therein and the tape support is receivable through the hole to secure the hang tag in the housing.

2. The tape dispenser in accordance with claim 1, wherein the hang tag comprises a tab and a lower section; the lower section being secured within the housing and the tab extending outwardly from the housing.

3. The tape dispenser in accordance with claim 2, wherein the lower section of the hang tag defines the hole therein and the tape support is receivable through the hole to secure the lower section in the housing.

4. The tape dispenser in accordance with claim 2, wherein the tab defines an aperture, and the tab is adapted to receive a hook from a display board through the aperture.

5. The tape dispenser in accordance with claim 4, wherein the tab is less than 20% of the area of the housing.

6. The tape dispenser in accordance with claim 4, wherein the tab is between 10% and 15% of the area of the housing.

7. The tape dispenser in accordance with claim 4, wherein the tab is substantially smaller than the size of the housing.

8. The tape dispenser in accordance with claim 4, wherein the housing has an upper surface and the hang tag further defines a plurality of perforations configured to the shape of the upper surface of the housing.

9. The tape dispenser in accordance with claim 4, further comprising a neck section disposed between the tab and lower section of the hang tag.

10. The tape dispenser in accordance with claim 9, wherein the neck section is narrower than the tab and the lower section.

11. The tape dispenser in accordance with claim 10, further comprising a fold line disposed between the tab and the neck section.

12. The tape dispenser in accordance with claim 11, further comprising a second fold line disposed between the neck section and the lower section.

* * * * *